US007689137B2

(12) United States Patent
Oda et al.

(10) Patent No.: US 7,689,137 B2
(45) Date of Patent: Mar. 30, 2010

(54) LIQUID VOLUME DETECTOR, LIQUID MIXTURE SUPPLYING SYSTEM ADOPTING SUCH LIQUID VOLUME DETECTOR AND IMAGE FORMING APPARATUS

(75) Inventors: Tomoyuki Oda, Osaka (JP); Nobuhiro Horiuchi, Osaka (JP); Jumpei Hobo, Osaka (JP); Koji Murase, Osaka (JP); Hiroyuki Ueda, Osaka (JP); Hidenori Takenaka, Osaka (JP)

(73) Assignee: Kyocera Mita Corporation (JP)

( * ) Notice: Subject to any disclaimer, the term of this patent is extended or adjusted under 35 U.S.C. 154(b) by 299 days.

(21) Appl. No.: 11/985,420

(22) Filed: Nov. 15, 2007

(65) Prior Publication Data

US 2008/0112719 A1 May 15, 2008

(30) Foreign Application Priority Data

Nov. 15, 2006 (JP) ..... 2006-309540

(51) Int. Cl.
*G03G 15/10* (2006.01)

(52) U.S. Cl. ..... 399/57; 399/237

(58) Field of Classification Search ..... 399/57, 399/233, 237, 238, 239
See application file for complete search history.

(56) References Cited

U.S. PATENT DOCUMENTS 6,687,477 B2 * 2/2004 Ichida et al. ..... 399/237
7,004,650 B2 * 2/2006 Sasaki et al. ..... 396/578

FOREIGN PATENT DOCUMENTS

JP 59-126570 7/1984

* cited by examiner

*Primary Examiner*—Hoang Ngo
(74) *Attorney, Agent, or Firm*—Gerald E. Hespos; Anthony J. Casella

(57) ABSTRACT

A liquid volume detector for detecting the volume of a liquid in a container is provided with a liquid level detecting member which is arranged at a specified height position in the container and on which a load acts by the liquid when the liquid level in the container is located at the specified height position, and a first drive source connected to the liquid level detecting member for moving the liquid level detecting member.

18 Claims, 7 Drawing Sheets

LIQUID VOLUME DETECTOR, LIQUID MIXTURE SUPPLYING SYSTEM ADOPTING SUCH LIQUID VOLUME DETECTOR AND IMAGE FORMING APPARATUS

BACKGROUND OF THE INVENTION

1. Field of the Invention

The present invention relates to a liquid volume detector for detecting the volume of a liquid in a container capable of containing the liquid, a liquid mixture supply system adopting such a liquid volume detector and an image forming apparatus.

2. Description of the Related Art

An image forming apparatus is provided with an image forming assembly for forming an image on a sheet based on image information, a fixing device for fixing the image formed in the image forming assembly to the sheet, and a discharging device for discharging the sheet having the image fixed thereto in the fixing device. In this image forming apparatus, the image is formed on the sheet in the image forming assembly and fixed in the fixing device. The sheet having the image fixed thereto is discharged from the discharging device.

In some of image forming apparatuses using liquid developers, residual developers, which were not used for development at the time of image development, are collected for reutilization. In an image forming apparatus of such a type, a residual developer is collected into a container containing the developer and supplied to a developing device provided in the image forming assembly to be reused after agitation and density adjustment.

In such an image forming apparatus, the developer is supplied to the container if the volume of the developer in the container decreases. The supply of the developer is stopped if a liquid volume detector detects that the volume of the developer in the container has reached a specified level (see Japanese Unexamined Patent Publication No. S59-126570).

In the liquid volume detector disclosed in this patent literature, a float is accommodated in the container and moves up and down in the container according to the volume of the developer and the liquid volume is detected depending on the position of the float. The supply of the residual developer is stopped when the float moves to an uppermost position. However, if the viscosity of the developer is high, there are cases where the position of the float does not move up even if the volume of the developer increases. Thus, it is difficult to accurately regulate the volume of the developer in the container due to, for example, the excessive supply of the developer into the container.

SUMMARY OF THE INVENTION

In order to solve the above problems, an object of the present invention is to make it easier to accurately control the volume of a liquid in a container containing the liquid such as a developer having a high viscosity.

In order to accomplish the above object, one aspect of the present invention is directed to a liquid volume detector for detecting the volume of a liquid in a container, comprising a liquid level detecting member which is provided at a specified height position in the container and on which a load acts by the liquid when the liquid level in the container is located at the specified height position; and a first drive source connected to the liquid level detecting member for moving the liquid level detecting member.

Another aspect of the present invention is directed to a liquid mixture supply system, comprising a liquid consuming device for consuming a liquid mixture containing a first component and a second component; a liquid regulator for forming the liquid mixture having a mixing ratio of the first and second components regulated; a first supply system for supplying the first component to the liquid regulator; a second supply system for supplying the second component to the liquid regulator; a third supply system for supplying the liquid mixture formed in the liquid regulator to the liquid consuming device; and a collection system for collecting the liquid mixture, which was supplied to the liquid consuming device, but not consumed by the liquid consuming device, and supplying it to the liquid regulator, wherein the liquid regulator includes a container for containing the liquid mixture and a liquid volume detector for detecting the volume of the liquid mixture in the container, the liquid volume detector including a liquid level detecting member which is provided at a specified height position in the container and on which a load acts by the liquid mixture when the liquid level in the container is located at the specified height position, and a first drive source connected to the liquid level detecting member for moving the liquid level detecting member.

Still another aspect of the present invention is directed to an image forming apparatus, comprising a photoconductive drum for bearing a toner image on the outer circumferential surface thereof; a developing device to be replenished with a liquid developer containing toner particles and a carrier and adapted to supply the liquid developer to the photoconductive drum; a developer former for forming the liquid developer having a mixing ratio of the toner particles and the carrier regulated; a first supply system for supplying a liquid developer having a toner density higher than a liquid developer to be used in the developing device to the developer former; a second supply system for supplying the carrier to the developer former; a third supply system for supplying the liquid developer formed in the developer former to the developing device via a reserve tank; and a collection system for collecting the liquid developer which was supplied to the developing device but not consumed by the developing device or the photoconductive drum, and supplying it to the developer former, wherein the developer former includes a container for containing the liquid developer and a liquid volume detector for detecting the volume of the liquid developer in the container, the liquid volume detector including a liquid level detecting member which is provided at a specified height position in the container and on which a load acts by the liquid developer when the liquid level in the container is located at the specified height position, and a first drive source connected to the liquid level detecting member for moving the liquid level detecting member.

These and other objects, features, aspects and advantages of the present invention will become more apparent upon a reading of the following detailed description with reference to accompanying drawings.

DETAILED DESCRIPTION OF THE PREFERRED EMBODIMENTS

Figure 1:
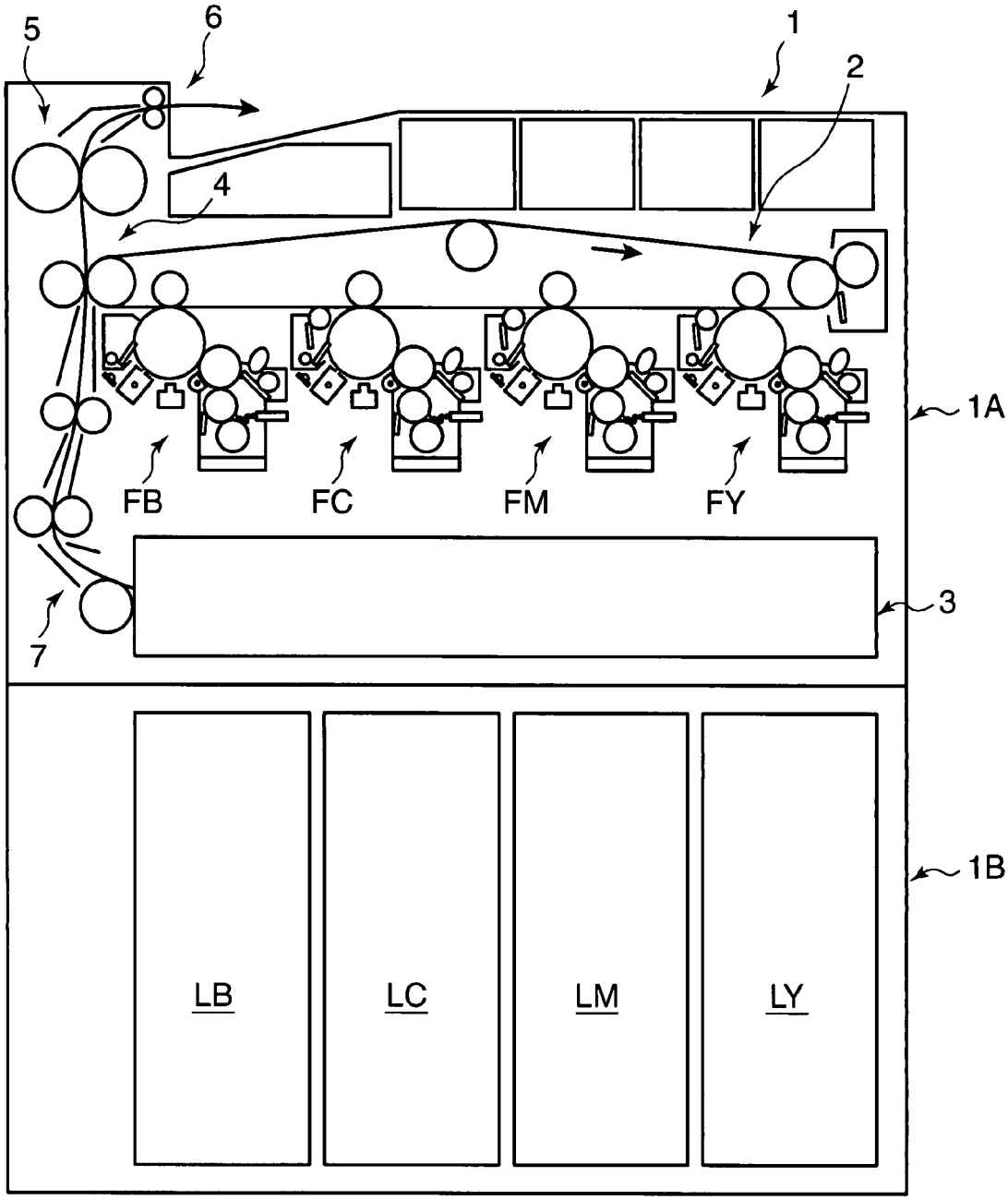
FIG. 1 is a schematic section entirely showing a color printer according to one embodiment of the invention.

Hereinafter, one embodiment of an image forming apparatus according to the present invention is described with reference to the accompanying drawings. It should be noted that the positions, sizes and the like of members are suitably emphasized in the drawings for the convenience of description. Although a color printer is described as an example of the image forming apparatus of the present invention in the following embodiment, the present invention is not limited thereto. It is sufficient for the image forming apparatus according to the present invention to include an image forming assembly, and this image forming apparatus may be a so-called complex machine (MFP: Multi Function Peripheral) having functions as a copier and a facsimile machine or may have only a copy function. The specific constructions of these members, other members and the like described below can be suitably changed.

1. Overall Construction

The schematic construction of a color printer 1 as the image forming apparatus according to one embodiment of the present invention is described with reference to FIGS. 1 to 3. FIG. 1 is a schematic section showing the overall construction of the color printer 1, FIG. 2 is a schematic section of the color printer 1 excluding liquid developer circulators, and FIG. 3 is a section enlargedly showing one image forming assembly.

As shown in FIG. 1, the color printer 1 is comprised of an upper main body 1A accommodating various units and parts for image formation, and a lower main body 1B accommodating liquid developer circulators LY, LM, LC and LB (liquid mixture supply system) for the respective colors. Here, pipes and the like connecting the upper and lower main bodies 1A, 1B are not shown.

Figure 2:
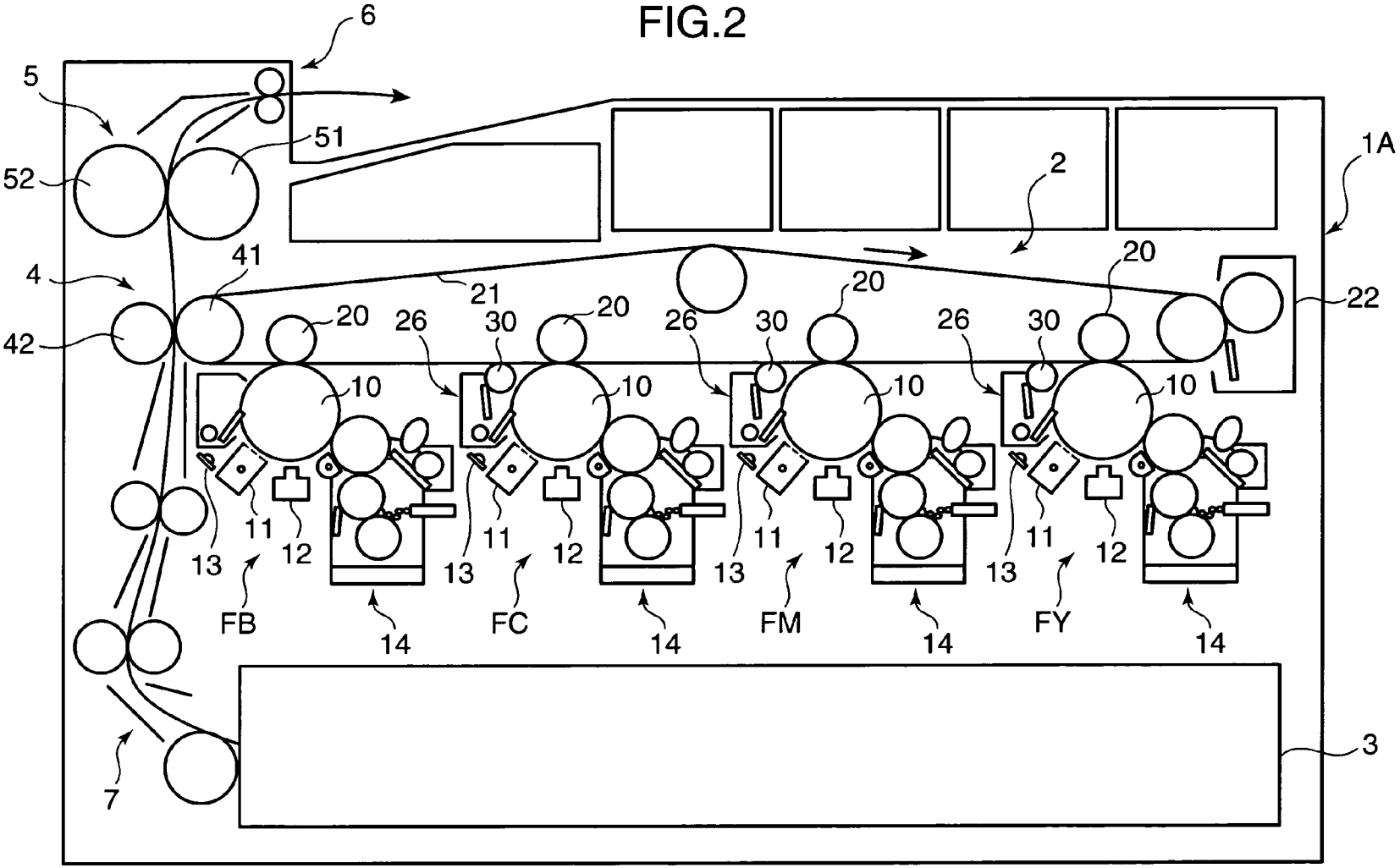
FIG. 2 is a schematic section of the color printer excluding liquid developer circulators.
Figure 3:
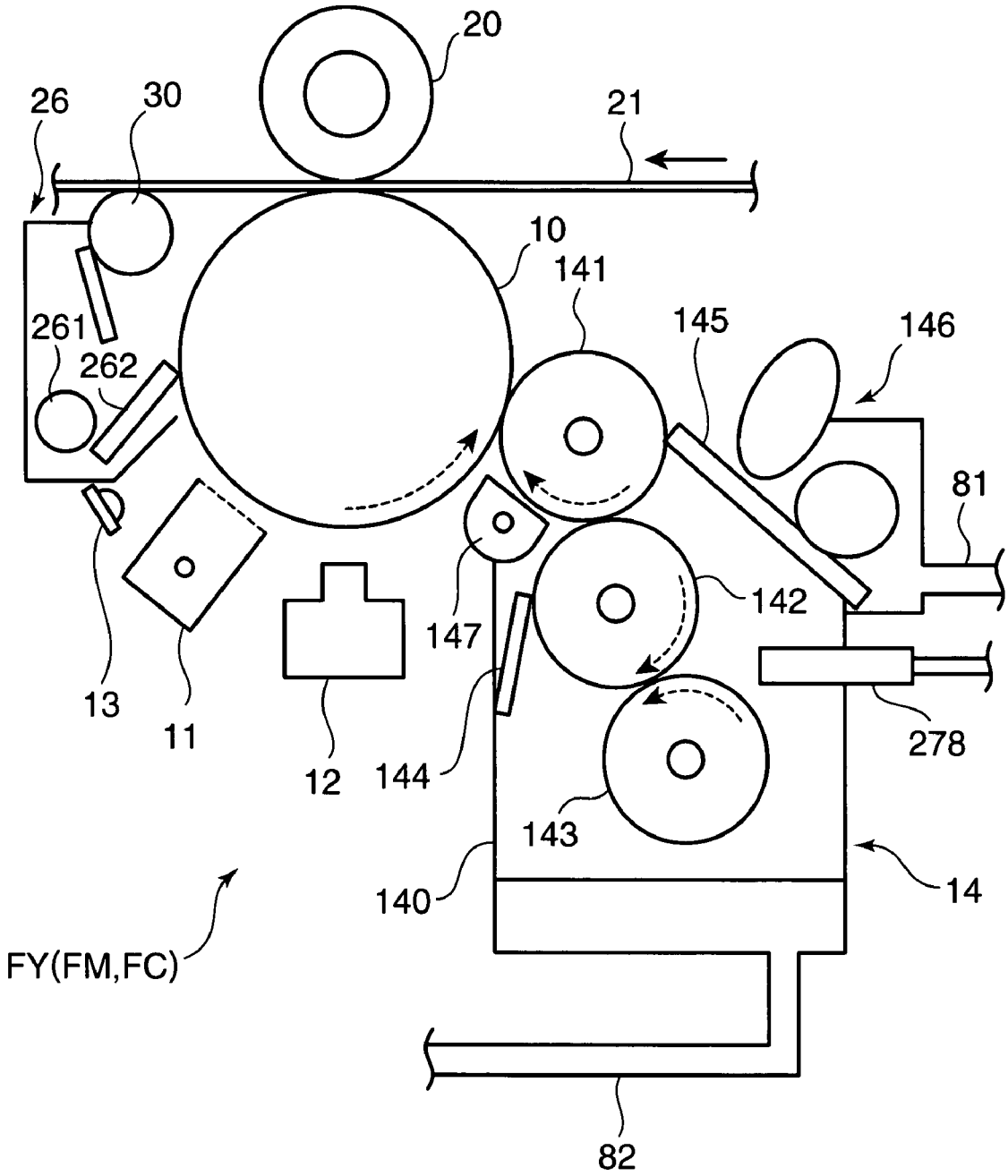
FIG. 3 is a section enlargedly showing one image forming assembly.

As shown in FIG. 2, the upper main body 1A includes a tandem image forming assembly 2 for forming a toner image based on an image data, a sheet accommodating section 3 accommodating sheets, a secondary transfer device 4 for transferring a toner image formed in the image forming unit 2 to a sheet, a fixing device 5 for fixing the transferred toner image to the sheet, a discharging device 6 for discharging the sheet having the image fixed thereto, and a sheet conveying assembly 7 for conveying sheets from the sheet accommodating section 3 to the discharging device 6.

The image forming assembly 2 includes an intermediate transfer belt 21, a cleaner 22 for the intermediate transfer belt 21, and image forming units FY, FM, FC and FB corresponding to the respective colors of yellow (Y), magenta (M), cyan (C) and black (Bk).

The intermediate transfer belt 21 is a belt-like member which is electrically conductive, wider than a dimension of maximum usable sheets in a direction normal to a sheet conveying direction and endless, i.e. looped, and is driven to turn clockwise in FIGS. 1 and 2. A surface of the intermediate transfer belt 21 facing outward during a turning movement thereof is referred to as a front surface, and the other surface thereof to a rear surface below.

The four image forming units FY, FM, FC and FB are arranged side by side near the intermediate transfer belt 21 between the cleaner 22 for the intermediate transfer belt 21 and the secondary transfer device 4. Although the arrangement order of the respective image forming units FY, FM, FC and FB is not limited to the above, this arrangement is preferable in view of the influence of the mixing of the respective colors on completed images.

Each of the image forming units FY, FM, FC and FB includes a photoconductive drum 10, a charger 11, an LED exposure device 12, a developing device 14, a primary transfer roller 20, a cleaning device 26, a charge neutralizer 13 and a carrier liquid removing roller 30. Out of the image forming units, the image forming unit FB located closest to the secondary transfer device 4 includes no carrier liquid removing roller 30, but is identical in the other construction.

The liquid developer circulators LY, LM, LC and LB are provided in correspondence with the respective image forming units FY, FM, FC and FB for supplying and collecting the liquid developers of the respective colors. The liquid developer circulators LY, LM, LC and LB are described in detail later.

The photoconductive drum 10 is a cylindrical member and can bear a toner image including charged toner particles (positively charged in this embodiment) on the outer circumferential surface. The photoconductive drum 10 is rotatable counterclockwise in FIGS. 2 and 3.

The charger 11 is a device capable of uniformly charging the outer circumferential surface of the photoconductive drum 10.

The exposure device 12 includes a light source such as an LED and irradiates the uniformly charged outer circumferential surface of the photoconductive drum 10 with light in accordance with an image data inputted from an external apparatus. Thus, an electrostatic latent image is formed on the outer circumferential surface of the photoconductive drum 10.

The developing device 14 (liquid consuming device) attaches toner particles to the electrostatic latent image by retaining the liquid developer (liquid mixture) containing toner particles (first component) and liquid carrier (second component) to face the electrostatic latent image on the outer circumferential surface of the photoconductive drum 10. Thus, the electrostatic latent image is developed into a toner image.

With reference to FIG. 3, the developing device 14 includes a developer container 140, a development roller 141, a supply roller 142, a support roller 143, a support roller blade 144, a development roller cleaning blade 145, a developer collector 146 and a development roller charger 147.

The developer container 140 is a container for receiving the supply of a liquid developer comprised of toner particles and liquid carrier inside. As described later, this liquid developer is supplied into the developer container 140 via a supply nozzle 278 with the densities of the toner particles and the carrier regulated beforehand. The liquid developer is supplied toward a nip portion between the supply roller 142 and the support roller 143, and a surplus is caused to drop below the support roller 143 and stored at the bottom of the developer container 140. The stored liquid developer is collected by the liquid developer circulator via a pipe 82 (see FIG. 4).

The support roller 143 is arranged substantially in the center of the developer container 140 and so held in contact with the supply roller 142 as to support the supply roller 142 from below, thereby forming the nip portion. The supply roller 142 is arranged not right above the support roller 143, but obliquely above the support roller 143 in a direction away from the supply nozzle 278, and has grooves for retaining the liquid developer formed in the outer circumferential surface thereof. As shown by dotted line arrows in FIG. 3, the support roller 143 rotates counterclockwise and the supply roller 142 rotates clockwise.

The liquid developer supplied from the supply nozzle 278 is temporarily accumulated at a side upstream of the nip portion in the rotating direction, and is carried upward while being retained in the above grooves of the supply roller 142 as the two rollers 142, 143 rotate. The supply roller blade 144 is pressed into contact with the outer circumferential surface of the supply roller 142 to restrict the volume of the liquid developer retained by the supply roller 142 to a specified volume. The surplus liquid developer scraped off by the supply roller blade 144 is received at the bottom of the developer container 140.

The development roller 141 is so arranged in an upper opening of the developer container 140 as to touch the supply roller 142. The development roller 141 is rotated in the same direction as the supply roller 142, whereby the liquid developer retained on the outer circumferential surface of the supply roller 142 is transferred to the outer circumferential surface of the development roller 141. Since the layer thickness of the liquid developer on the supply roller 142 is restricted to a specified value, the layer thickness of the liquid developer formed on the outer circumferential surface of the development roller 141 is also kept at a specified value.

The development roller charger 147 fulfills a function of causing the toner particles in the developer layer borne on the development roller 141 to transfer toward the outer circumferential surface side of the development roller 141 by giving a charging potential having the same polarity as the charging polarity of the toner particles, thereby improving development efficiency. The development roller charger 147 is so provided as to face the outer circumferential surface of the development roller 141 at a side downstream of a contact portion of the development roller 141 with the supply roller 142 and upstream of a contact portion of the development roller 141 with the photoconductive drum 10 in the rotating direction.

The development roller 141 is in contact with the photoconductive drum 10, and a toner image corresponding to a given image data is formed on the outer circumferential surface of the photoconductive drum 10 by a potential difference between the potential of an electrostatic latent image on the outer circumferential surface of the photoconductive drum 10 and a development bias applied to the development roller 141 (developing operation).

The development roller cleaning blade 145 is so arranged as to touch the development roller 141 at a side downstream of the contact portion of the development roller 141 with the photoconductive drum 10 in the rotating direction and removes the liquid developer on the outer circumferential surface of the development roller 141 having finished the developing operation for the photoconductive drum 10.

The developer collector 146 collects the liquid developer removed by the development roller cleaning blade 145 and feeds the collected liquid developer to a pipe 81 of the corresponding liquid developer circulator. Although the liquid developer flows down along the outer surface of the development roller cleaning blade 145, a feed roller for assisting the feed of the liquid developer is provided in the developer collector 146 since the liquid developer has a high viscosity.

The primary transfer roller 20 is arranged to face the photoconductive drum 10 at the rear side of the intermediate transfer belt 21. A voltage having a polarity (negative in this embodiment) opposite to that of the toner particles in the toner image is applied to the primary transfer roller 20 from an unillustrated power supply. In other words, the primary transfer roller 20 applies a voltage having a polarity opposite to that of the toner particles to the intermediate transfer belt 21 at a contact position with the intermediate transfer belt 21. Since the intermediate transfer belt 21 is electrically conductive, the toner particles are attracted to the front side of the intermediate transfer belt 21 and its periphery by this applied voltage.

The cleaning device 26 is a device for cleaning the residual liquid developer left without being transferred from the photoconductive drum 10 to the intermediate transfer belt 21 and includes a residual developer conveying screw 261 and a cleaning blade 262. The residual developer conveying screw 261 is a member for conveying the residual developer scraped off by the cleaning blade 262 and contained in the cleaning device 26 to the outside of the cleaning device 26, and is arranged in the cleaning device 26.

The cleaning blade 262 is a plate-like member for scraping off the liquid developer residual on the outer circumferential surface of the photoconductive drum 10 and extends in a direction of the axis of rotation of the photoconductive drum 10. The cleaning blade 262 has an end thereof held in sliding contact with the outer circumferential surface of the photoconductive drum 10 to scrape off the liquid developer residual on the photoconductive drum 10 as the photoconductive drum 10 rotates.

The charge neutralizer 13 includes a light source for charge neutralization and neutralizes the outer circumferential surface of the photoconductive drum 10 by light from the light source after the liquid developer is removed by the cleaning blade 262 in preparation for a next image forming operation.

The carrier liquid removing roller 30 is a substantially cylindrical member rotatable in the same direction as the photoconductive drum 10 about an axis of rotation parallel to that of the photoconductive drum 10. The carrier liquid removing roller 30 is arranged at a position closer to the secondary transfer device 4 than to the contact position of the photoconductive drum 10 and the intermediate transfer belt 21, and removes the carrier liquid from the outer circumferential surface of the intermediate transfer belt 21.

Referring back to FIG. 2, the sheet accommodating section 3 is for accommodating sheets to which toner images are to be fixed, and arranged at the bottom of the upper main body 1A. The sheet accommodating section 3 includes a sheet cassette for accommodating sheets.

The secondary transfer device 4 is for transferring a toner image formed on the intermediate transfer belt 21 to the sheet and includes a support roller 41 for supporting the intermediate transfer belt 21 and a secondary transfer roller 42 arranged to face the support roller 41.

The fixing device 5 is for fixing a toner image to a sheet and arranged above the secondary transfer device 4. The fixing device 5 includes a heating roller 51 and a pressure roller 52 arranged to face the heating roller 51.

The discharging device 6 is for discharging a sheet having a toner image fixed thereto in the fixing device 5 and arranged at a top part of the color printer 1. The sheet conveying assembly 7 includes a plurality of pairs of conveyance rollers and conveys sheets from the sheet accommodating section 3 to the secondary transfer device 4, the fixing device 5 and the discharging device 6.

2. Liquid Developer Circulator

Figure 4:
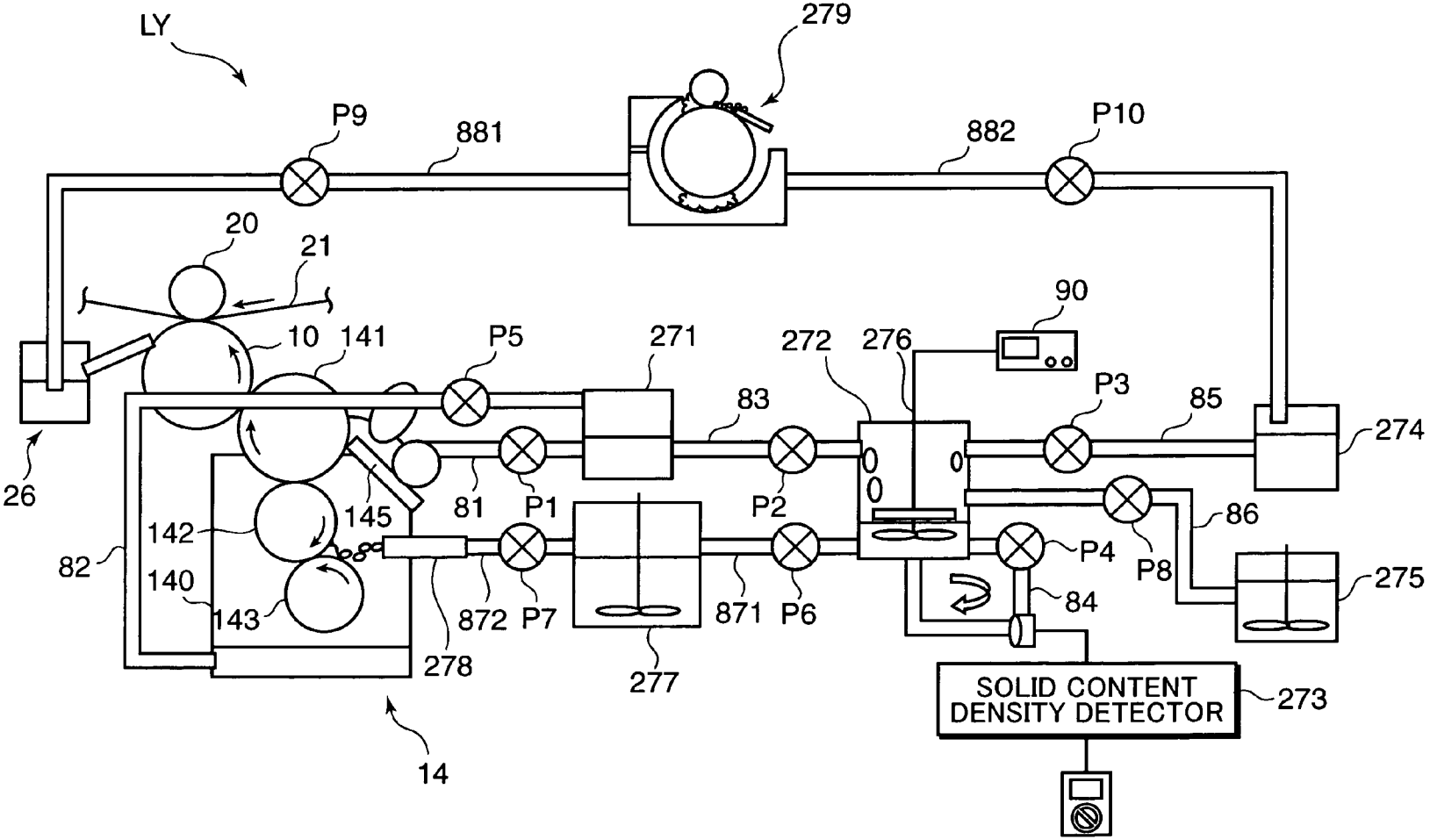
FIG. 4 is a construction diagram of the liquid developer circulator.

FIG. 4 schematically and entirely shows one liquid developer circulator LY. The other liquid developer circulators LM, LC and LB have the same construction. This liquid developer circulator LY is a device for circulating the residual developer (mixture of the toner particles and the carrier liquid) scrapped off from the outer circumferential surface of the development roller 141 by the development roller cleaning blade 145 for reutilization after the liquid developer is supplied to the photoconductive drum 10.

The liquid developer circulator LY includes a residual developer tank 271, a developer adjusting device 272 (container/liquid regulator/developer former as claimed), a solid content density detector 273, a carrier tank 274, a toner tank 275, a liquid volume detector 276, a developer reserve tank 277, a liquid developer supplier (supply nozzle 278), a carrier separator 279 and a plurality of pumps P1 to P10.

The residual developer tank 271 is a tank connected to the developing device 14 via first and second pipes 81, 82 and capable of containing the liquid developer collected from the developing device 14. The first and fifth pumps P1, P5 are respectively mounted at intermediate positions of the first and second pipes 81, 82.

The liquid developer scraped off from the outer circumferential surface of the development roller 141 by the development roller cleaning blade 145 after the toner particles is supplied to the photoconductive drum 10 is transferred to the residual developer tank 271 via the first pipe 81 by driving the first pump P1. Further, the liquid developer collected into the developer container 140 without being supplied from the supply roller 142 to the development roller 141 is transferred to the residual developer tank 271 via the second pipe 82 by driving the fifth pump P5.

The developer adjusting device 272 is a device connected to the residual developer tank 271. In the developer adjusting device 272, the residual developer is added with a developer having a toner density higher than those used in the developing device or a carrier liquid to thereby adjust the toner density of the residual developer to a proper value. The liquid developer is supplied to the developing device 14 from the developer adjusting device 272. The developer adjusting device 272 is connected to the residual developer tank 271 via a third pipe 83, in which the second pump P2 is mounted. The liquid developer in the residual developer tank 271 is transferred to the developer adjusting device 272 via the third pipe 83 by driving the second pump P2 (above, collection system).

The solid content density detector 273 is a device for detecting the density of the toner particles in the liquid developer in the developer adjusting device 272. The solid content density detector 273 is connected with a looped fourth pipe 84 connected with the developer adjusting device 272. The fourth pump P4 is mounted in this looped fourth pipe 84. The liquid developer in the developer adjusting device 272 is introduced to the solid content density detector 273 from the entrance end of the fourth pipe 84 by driving the fourth pump P4 and returned to the developer adjusting device 272 from the exit end of the fourth pipe 84.

The carrier tank 274 is a tank containing the carrier liquid. If the solid content density detector 273 judges that the toner density in the developer adjusting device 272 is higher than a proper value, the carrier liquid is supplied from the carrier tank 274 into the developer adjusting device 272 to decrease the toner density of the liquid developer in the developer adjusting device 272. The carrier tank 274 and the developer adjusting device 272 are connected via a fifth pipe 85, and the carrier liquid is supplied by driving the third pump P3 mounted at an intermediate position of the fifth pipe 85 (second supply system).

The toner tank 275 is a tank containing a liquid developer having a toner density higher than the liquid developer used in the developing device 14. If the solid content density detector 272 judges that the toner density in the developer adjusting device 272 is lower than a proper value, the liquid developer having a higher toner density than the liquid developer used in the developing device 14 is supplied from the toner tank 275 into the developer adjusting device 272 to increase the toner density of the liquid developer in the developer adjusting device 272. The toner tank 275 and the developer adjusting device 272 are connected via a sixth pipe 86, and the liquid developer is supplied by driving the eighth pump P8 mounted at an intermediate position of the sixth pipe 86 (first supply system).

Figure 5:
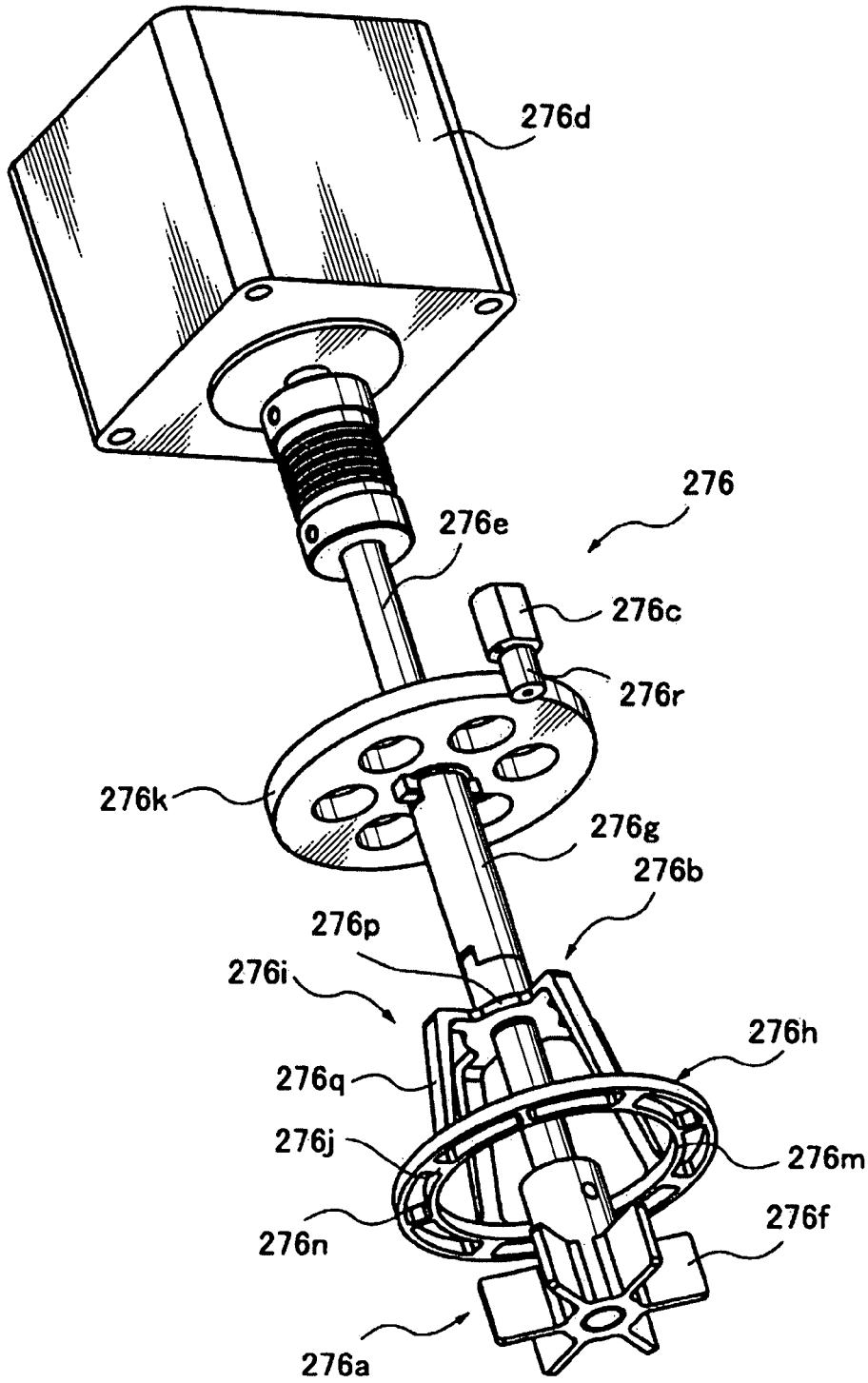
FIG. 5 is a perspective view entirely showing a liquid volume detector.
Figure 6:
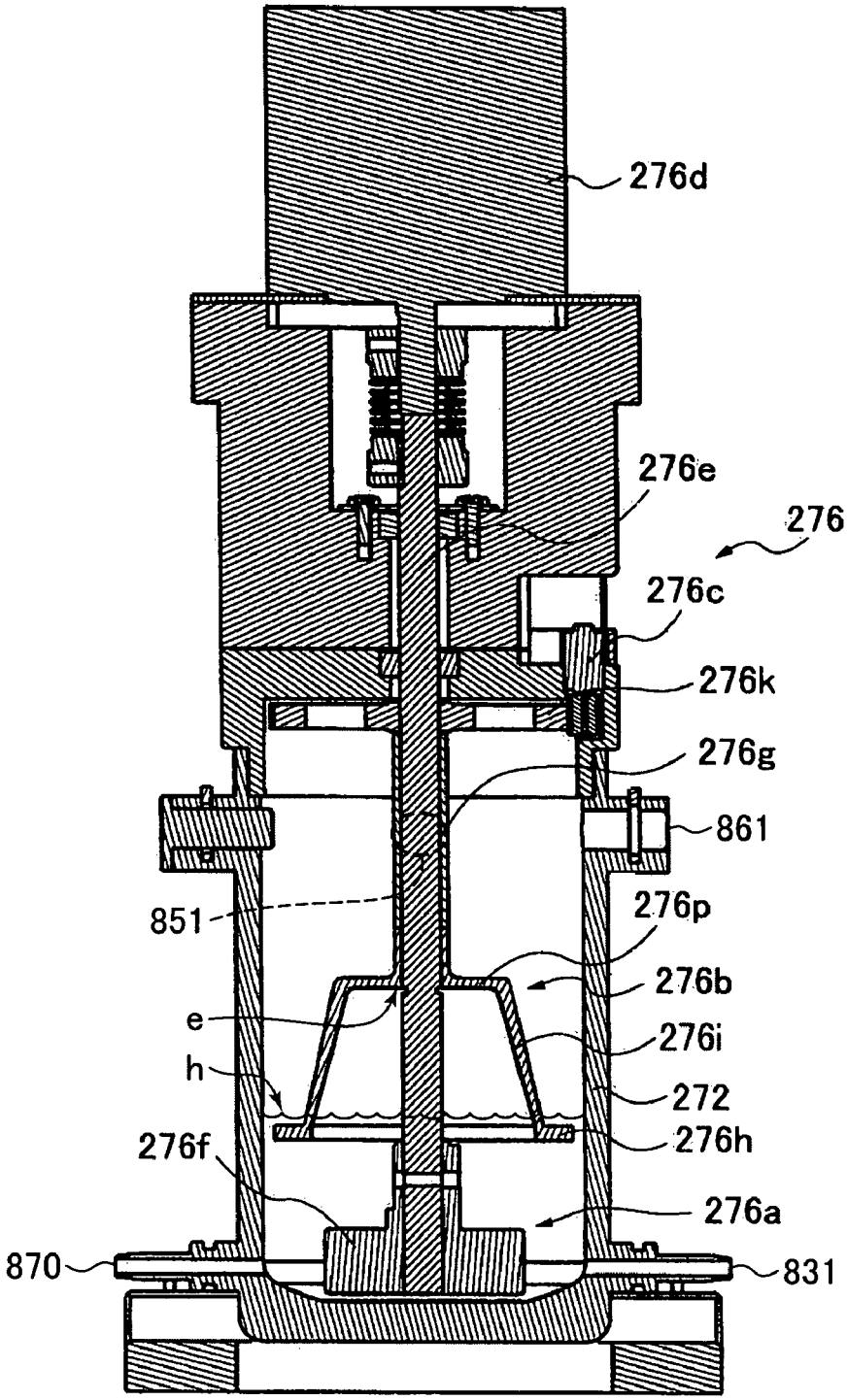
FIG. 6 is a section entirely showing the liquid volume detector.

The liquid volume detector 276 is a device for detecting the volume of the developer in the developer adjusting device 272, and the entire construction thereof is shown in FIGS. 5 and 6. This liquid volume detector 276 is arranged in the developer adjusting device 272 and includes an agitating member 276*a*, a liquid level detecting member 276*b*, a first motor 276*c* for detecting the liquid level (first drive source) and a second motor 276*d* for agitation (second drive source).

The agitating member 276*a* is a member for agitating the liquid developer in the developer adjusting device 272 and includes a first rotary shaft 276*e* and a first fin member 276*f*. The first rotary shaft 276*e* has the upper end thereof connected with an output rotary shaft of the second motor 276*d*. The first fin member 276*f* includes a tubular portion provided around the bottom end of the first rotary shaft 276*e* and fin-shaped members mounted to radially extend outward from the tubular portion. The first fin member 276*f* is fixed to the leading end of the first rotary shaft 276*e* and rotates as the first rotary shaft 276*e* rotates.

The liquid level detecting member 276*b* is a member which is provided at a specified height position in the developer adjusting device 272 and on which a load acts by the liquid (liquid developer here) agitated by the agitating member 276*a* when a liquid level h in the developer adjusting device 272 is at a specified height position. The liquid level detecting member 276*b* includes a second rotary shaft 276*g*, an annular member 276*h*, a connecting member 276*i* and second fin-shaped members 276*j*.

The secondary rotary shaft 276*g* is a tubular part through which the first rotary shaft 276*e* passes, and a disk-shaped gear member 276*k* having gear teeth formed on the outer circumferential surface thereof is mounted at the upper end of the secondary rotary shaft 276*g*. Further, the second rotary shaft 276*g* is shorter than the first rotary shaft 276*e* and rotatable relative to the first rotary shaft 276*e*.

As shown in FIG. 6, the position of a leading end e of the second rotary shaft 276*g* is so set on the first rotary shaft 276*e* as not to be substantially immersed in the liquid level h. If the second rotary shaft 276*g* touches the liquid developer, it directly leads to an increase of a rotational load and the liquid developer might enter a gap between the first rotary shaft 276*e* and the second rotary shaft 276*g* to deteriorate the rotation capability of the second rotary shaft 276*g*. By setting the position of the leading end e as described above, such problems can be avoided.

The annular member 276*h* is disposed at a position higher than (above) the first fin member 276*f*, and includes a first annular member 276*m* arranged at a radially inner side and a second annular member 276*n* arranged at a radially outer side of the first annular member 276*m*. The first and second annular members 276*m*, 276*n* are concentrically arranged, and the inner diameter of the second annular member 276*n* is set larger than the outer diameter of the first annular member 276*m*. Further, the annular member 276*h* is arranged to be proximate to the inner wall of the developer adjusting device 272. It should be noted that the inner diameter of the first annular member 276*m* is larger than the outer diameter of the first fin member 276*f*.

The first and second annular members 276*m*, 276*n* are connected by a plurality of second fin-shaped members 276*j*. The second fin-shaped members 276*j* are plate-like parts arranged between the first and second annular members 276*m*, 276*n*. Here is shown an example in which eight second fin-shaped members 276*j* are circumferentially arranged at equal intervals and spaces are defined between the respective second fin-shaped members 276*j*.

Here, the annular member 276*h* may be formed such that the second fin-shaped members 276*j* radially extend outward from the outer circumferential surface of the first annular member 276*m*. However, the annular member 276*h* can have a high strength by providing the second fine-shaped members 276*j* between the two annular members 276*m*, 276*n*.

The annular member 276*h* and the second rotary shaft 276*g* are connected by the connecting member 276*i* having one end thereof connected with the first annular member 276*m* and the other end thereof connected with the leading end e of the second rotary shaft 276*g*. The connecting member 276*i* includes a disk portion 276*p* mounted at the bottom end of the leading end e of the second rotary shaft 276*g* and four L-shaped strip portions 276*q* extending downward from the disk portion 276*p*.

A first receiving hole 851 connected with the fifth pipe 85 for supplying the carrier liquid is provided near the upper end of the developer adjusting device 272. A second receiving hole 861 connected with the sixth pipe 86 for supplying the liquid developer having a higher toner density than the liquid developer used in the developing device 14 is provided at the same height position as the first receiving hole 851 and shifted by 90° in a circumferential direction of the developer adjusting device 272. Further, a third receiving hole 831 connected with the third pipe 83 for supplying the residual developer and a discharge hole 870 for discharging the liquid developer toward the developer reserve tank 277 are provided near the bottom end of the developer adjusting device 272.

The first motor 276*c* is a member for rotating the liquid level detecting member 276*b*. A pinion gear 276*r* in mesh with the disk-shaped gear member 276*k* of the second rotary shaft 276*g* is mounted on an output rotary shaft of the first motor 276*c*.

The second motor 276*d* is a member for rotating the first fin member 276*f* and arranged at the upper end of the first rotary shaft 276*e*.

The developer reserve tank 277 is a tank containing the liquid developer to be supplied to the developing device 14. The developer reserve tank 277 is connected to the developer adjusting device 272 via a seventh pipe 871, and receives the supply of the liquid developer from the developer adjusting device 272 by driving the sixth pump P6 provided at an intermediate position of the seventh pipe 871.

The supply nozzle 278 is a member for supplying the liquid developer stored in the developer reserve tank 277 to the developing device 14 (developer container 140). The supply nozzle 278 and the developer reserve tank 277 are connected via an eighth pipe 872, and the liquid developer is supplied by driving the seventh pump P7 mounted in the eighth pipe 872 (above, third supply system).

The carrier separator 279 is a device for separating and extracting the carrier liquid from the residual developer collected in the cleaning device 26. The cleaning device 26 and the carrier separator 279 are connected via a ninth pipe 881 in which the ninth pump P9 is mounted. The residual developer in the cleaning device 26 is fed to the carrier separator 279 by driving the ninth pump P9. Further, a tenth pipe 882 having the tenth pump P10 mounted therein is provided between the carrier separator 279 and the carrier tank 274. The carrier liquid extracted by the carrier separator 279 is fed to the carrier tank 274 by driving the tenth pump P10.

Although not shown, liquid level detectors for detecting liquid levels in the residual developer tank 271, the carrier tank 274, the toner tank 275 and the residual developer reserve tank 277 are provided at suitable positions of these tanks.

The driving of the first motor 276*c*, the second motor 276*d* and the first to tenth pumps P1 to P10 described above is controlled by a controller 90. The controller 90 includes a CPU (Central Processing Unit) for performing arithmetic operations, a ROM (Read Only Memory) storing control programs and the like, and a RAM (Random Access Memory) for temporarily saving data for arithmetic and control operations.

Figure 7:
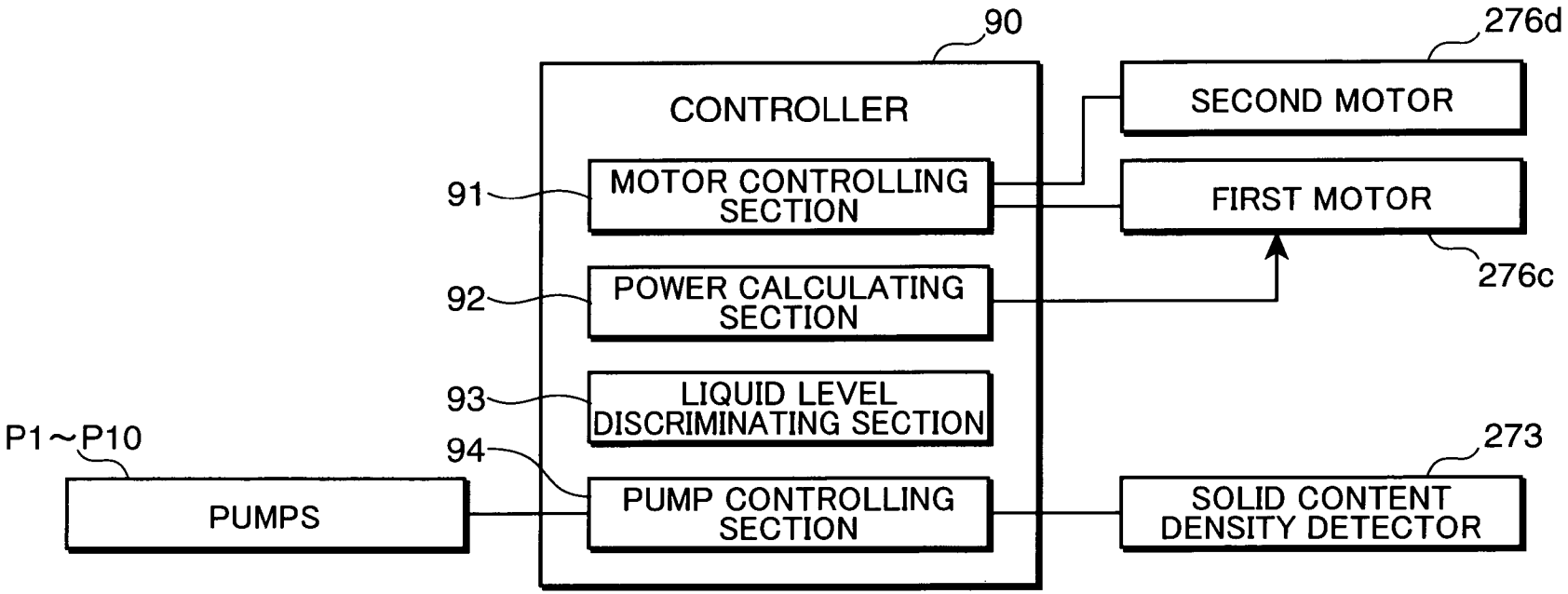
FIG. 7 is a block diagram of a controller.

FIG. 7 is a block diagram showing the functional construction of the controller 90. The controller 90 is provided with a motor controlling section 91, a power calculating section 92, a liquid level discriminating section 93 and a pump controlling section 94.

The motor controlling section 91 controls the rotational driving of the first and second motors 276*c*, 276*d*. Specifically, the motor controlling section 91 actuates the first motor 276*c* for liquid volume detection to rotate the liquid level detecting member 276*b*, and actuates the second motor 276*d* to rotate the agitating member 276*a* for the agitation of the liquid developer in the developer adjusting device 272.

The power calculating section 92 successively calculates the power consumed by the first motor 276*c*. This power can be obtained from a load current and an applied voltage of the first motor 276*c*. It should be noted that a change of the load current of the first motor 276*c* may be simply monitored. The load current of the first motor 276*c* changes depending on a load acting on the liquid level detecting member 276*b*. If the liquid level h of the liquid developer in the developer adjusting device 272 increases and the annular member 276*h* touches the liquid developer, the above load increases and the load current also increases. The power calculating section 92 detects such a change of the power consumption or the load current and outputs a detected content to the liquid level discriminating section 93.

The liquid level discriminating section 93 discriminates whether or not the height of the liquid level h of the liquid developer has exceeded a specified value based on the output data of the power calculating section 92. For example, the liquid level discriminating section 93 judges that the height of the liquid level h has exceeded the specified value when the power consumption or the load current of the first motor 276*c* exceeds a threshold value set beforehand using an average value during three seconds.

The pump controlling section 94 feeds a control signal to drive or stop to the first to tenth pumps P1 to P10, thereby controlling the operations of these pumps. Particularly in this embodiment, the operations of the relevant pumps are controlled in view of the discrimination result by the liquid level discriminating section 93 and the judgment result on the toner density by the solid content density detector 273.

3. Operation

First, an image forming operation of the wet-type color printer 1 according to this embodiment is described. Upon receiving an image forming instruction from a personal computer (not shown) connected therewith, the color printer 1 forms toner images of the respective colors corresponding to a received image data for image formation by means of the image forming units FY, FM, FC and FB. Specifically, electrostatic latent images based on the image data are formed on the photoconductive drums 10, and the liquid developer is supplied to these electrostatic latent images from the developing devices 14. The images formed in the respective image forming units in this way are transferred to the intermediate transfer belt 21 and superimposed thereon to become a color toner image.

In synchronism with the formation of this color toner image, one sheet accommodated in the sheet accommodating section 3 is dispensed from the sheet accommodating section 3 by an unillustrated sheet feeder and conveyed along the sheet conveying assembly 7. The sheet is fed to the secondary transfer device 4 while being timed with the primary transfer to the intermediate transfer belt 21, and the color toner image on the intermediate transfer belt 21 is secondarily transferred to the sheet in the secondary transfer device 4.

The sheet-having the color toner image transferred thereto is transferred to the fixing device 5 to be heated and pressed, whereby this color toner image is fixed to the sheet. The sheet is further discharged to the outside of the wet-type color printer 1 by the discharging device 6. After the secondary transfer, the toner residual on the intermediate transfer belt 21 is removed therefrom by the cleaner 22 for the intermediate transfer belt 21.

Next, an operation of supplying the liquid developer to the developing device 14, i.e. an operation of circulating the liquid developer is described.

The liquid developer residual on the development roller 141 without being supplied to the photoconductive drum 10 during the image forming operation is scrapped off by the development roller cleaning blade 145, and collected into the residual developer tank 271 via the first pipe 81. The liquid developer collected into the developer container 140 without being supplied from the supply roller 142 to the development roller 141 is also collected into the residual developer tank 271 via the second pipe 82. Further, the carrier liquid extracted in the carrier separator 279 from the residual developer collected in the cleaning device 26 is collected into the carrier tank 274. The pump controlling section 94 causes the first, fifth, ninth and tenth pumps P1, P5, P9 and P10 to be driven to circulate such liquids.

When the developer adjusting device 272 becomes empty, the pump controlling section 94 causes the second pump P2 to be driven, whereby the residual developer is supplied from the residual developer tank 271 to the developer adjusting device 272.

By driving the first and second motors 276*c*, 276*d* by means of the motor controlling section 91, the agitating member 276*a* and the liquid level detecting member 276*b* are constantly rotating in the developer adjusting device 272. The liquid developer in the developer adjusting device 272 is agitated by the agitating member 276*a*, and the liquid developer has a conical outer surface (liquid level h) by this agitation.

When the liquid level h of the liquid developer reaches a position at the same height as or higher than a specified height position, the annular member 276*h* of the liquid level detecting member 276*b* touches the liquid developer. At this time, the annular member 276*h* is rotated by the first motor 276*c*, and loads acting on the second fin-shaped members 276*j* change since the liquid developer touches the second fin-shaped members 276*j*. Thus, power (current) necessary to actuate the first motor 276*c* changes.

The power consumption or load current of the first motor 276*c* is constantly monitored by the power calculating section 92. If the power consumption or load current exceeds a preset threshold value, the liquid level discriminating section 93 judges that the height of the liquid level h of the liquid developer has exceeded the specified value. In this case, the pump controlling section 94 causes the second pump P2 to be stopped, thereby stopping the supply of the residual developer to the developer adjusting device 272.

When the developer adjusting device 272 is filled with the residual developer, the solid content density detector 273 detects the toner density of the liquid developer. According to the result of the detection, the pump controlling section 94 causes the third pump P3 or the eighth pump P8 to be driven to thereby supply a necessary amount of carrier liquid or liquid developer having a toner density higher than the liquid developer used in the developing device to the developer adjusting device 272. Thereafter, the solid content density detector 273 detects the toner density of the liquid developer. When the toner density of the liquid developer reaches a proper value, the density-regulated liquid developer is allowed to be supplied to the developer reserve tank 277 according to need. Further, the pump controlling section 94 suitably causes the seventh pump P7 to be driven, whereby the liquid developer stored in the developer reserve tank 277 is supplied to the developing device 14 via the supply nozzle 278.

According to the construction of this embodiment described above, the volume of the liquid developer in the developer adjusting device 272 is detected based on a change of the power consumption or load current of the first motor 276*c* for rotating the liquid level detecting member 276*b*. Thus, even if the viscosity of the liquid developer is high, accurate detection can be made. In other words, whether or not the liquid level h has reached the specified height position can be precisely detected. If the height of the liquid level h is too high, there are problems that agitation capability decreases and the toner particles and the carrier liquid are insufficiently mixed and the liquid developer leaks out of the developer adjusting device 272. According to this embodiment, such problems can be reliably avoided.

Since the liquid level detecting member 276*b* and the agitating member 276*a* are actuated by the different motors, a change of the power when the liquid level detecting member 276*b* is rotated can be easily confirmed. Further, the annular member 276*h* is arranged at a position radially more outward and higher than the first fin member 276*f*. Thus, the agitation of the liquid developer by the first fin member 276*f* is not hindered and the liquid level h can be easily detected.

Further, the first annular member 276*m* and the second rotary shaft 276*g* are separated from each other via the connecting member 276*i*. Thus, if the liquid developer having a high toner density and the carrier liquid are supplied to the developer adjusting device 272 from above an area of the strip portions 276*q* of the connecting member 276*i*, the rotation of the liquid level detecting member 276*b* can be hindered as little as possible.

Furthermore, the outer surface of the liquid developer becomes conical by agitating the liquid developer by means of the agitating member 276*a*. However, since the annular member 276*h* is arranged radially more outward than the agitating member 276*a*, the liquid volume can be detected without degrading the agitation performance of the agitating member 276*a*.

4. Other Embodiments (a) Although the color printer 1 is described in the above embodiment, the present invention is not limited thereto and is also applicable to other image forming apparatuses such as copiers and complex machines. Further, the present invention can be embodied as a liquid mixture supply system besides image forming apparatuses.

(b) In the above embodiment, the liquid developer is agitated using the first fin member 276*f*. However, the present invention is not limited thereto and the liquid developer may be agitated by another method or may not be agitated.

(c) In the above embodiment, the liquid level detecting member 276*b* including the annular member 276*h* is rotated. However, the liquid level detecting member is not limited thereto and may be, for example, such that a bar-shaped member having a liquid level sensing surface is linearly reciprocated.

(d) Since the wet-type color printer 1 is illustrated in the above embodiment, the supply of the residual developer to the developer adjusting device 272 is stopped by stopping the driving of the second pump P2 when the height of the liquid level of the liquid developer exceeds the specified value. In the case of applying the present invention to another liquid mixture supply system, the supply of the liquid to the developer adjusting device 272 (liquid regulator) from at least one of the second pump P2 (collection system), the third pump P3 (first supply system) and the eighth pump P8 (second supply system) may be stopped or the liquid mixture may be supplied to the liquid consuming device from the developer adjusting device 272 via the sixth pump P6 (third supply system) to reduce the volume of the liquid mixture in the developer adjusting device 272.

The specific embodiment described above mainly embraces inventions having the following constructions.

A liquid volume detector according to one aspect of the present invention for detecting the volume of a liquid in a container comprises a liquid level detecting member which is provided at a specified height position in the container and on which a load acts by the liquid when the liquid level in the container is located at the specified height position; and a first drive source connected to the liquid level detecting member for moving the liquid level detecting member.

In this case, the first drive source preferably rotates the liquid level detecting member.

According to this construction, the liquid level detecting member is moved (rotated) by the first drive source. At this time, a load acts on the liquid level detecting member if the liquid level is located at the same height position as or higher than the specified height position. Since power necessary to drive the first drive source changes in this case, it can be detected that the liquid level is located at the same height position as or higher than the specified height position.

Thus, the height position of the liquid level, i.e., the liquid volume can be accurately detected even if the viscosity of the liquid is high, wherefore the volume of the liquid in the container can be more easily controlled.

In the above construction, it is preferable to further comprise an agitating member arranged in the container for agitating the liquid and a second drive source connected to the agitating member for supplying a driving force for agitating the liquid to the agitating member. According to this construction, the liquid level can be more easily detected since the agitating member is driven by the drive source different from that for the liquid level detecting member.

In this case, the agitating member preferably includes a first rotary shaft connected with the second drive source and a first fin member connected with the first rotary shaft. Thus, the first fin member can rotate about the first rotary shaft to agitate the liquid in the container.

In the above construction, the liquid level detecting member preferably includes a second rotary shaft to be rotated by the first drive source, an annular member connected with the second rotary shaft and a second fin member provided around the annular member.

In this case, it is preferable that the annular member includes a first annular member having a specified outer diameter and a second annular member arranged concentrically with the first annular member and having an inner diameter larger than the outer diameter of the first annular member; and that the second fin member is provided between the first and second annular members. According to this construction, the annular member can have a high strength since the second fin member is supported by the two annular members.

Alternatively, in the above construction, it is preferable that the liquid level detecting member includes a tubular second rotary shaft to be driven by the first drive source, rotatable relative to the first rotary shaft and arranged around the first rotary shaft, an annular member connected with the second rotary shaft and a second fin member arranged around the annular member. According to this construction, the liquid level can be detected without being influenced by the rotation of the first rotary shaft (without being influenced by an agitating operation) since the first and second rotary shafts are rotatable relative to each other.

In the above construction, it is preferable that the leading end of the second rotary shaft is located at such a position of the first rotary shaft as not be substantially immersed into the liquid level; and that a connecting member connecting the leading end of the second rotary shaft and the annular member is further provided. According to this construction, an increase of the load caused by the contact of the second rotary shaft and the liquid can be deterred and the entrance of the liquid into a gap between the first and second rotary shafts can be prevented.

In the above construction, it is preferable that the annular member has an inner diameter larger than the outer diameter of the first fin member and is located at a height position higher than the first fin member. According to this construction, the liquid level can be detected even if the liquid is agitated by the agitating member and the upper outer surface of the liquid becomes conical.

A liquid mixture supply system according to another aspect of the present invention comprises a liquid consuming device for consuming a liquid mixture containing a first component and a second component; a liquid regulator for forming the liquid mixture having a mixing ratio of the first and second components regulated; a first supply system for supplying the first component to the liquid regulator; a second supply system for supplying the second component to the liquid regulator; a third supply system for supplying the liquid mixture formed in the liquid regulator to the liquid consuming device; and a collection system for collecting the liquid mixture, which was supplied to the liquid consuming device, but not consumed by the liquid consuming device, and supplying it to the liquid regulator, wherein the liquid regulator includes a container for containing the liquid mixture and a liquid volume detector for detecting the volume of the liquid mixture in the container, the liquid volume detector including a liquid level detecting member which is provided at a specified height position in the container and on which a load acts by the liquid mixture when the liquid level in the container is located at the specified height position; and a first drive source connected to the liquid level detecting member for moving the liquid level detecting member.

According to this construction, the height position of the liquid level, i.e., the liquid volume can be accurately detected even if the viscosity of the liquid is high, wherefore the volume of the liquid in the liquid regulator can be more easily controlled. Therefore, the liquid mixture can be properly circulated as designed.

In the above construction, it is preferable that the first drive source is a motor; that the liquid level detecting member is driven and rotated by the motor; that a detector for calculating power given to the motor is further provided; and that the detector detects a power change based on the action of a load of the liquid mixture on the liquid level detecting member.

According to this construction, the height of the liquid level can be detected by a simple construction without installing sensors for directly detecting the liquid level.

In this case, it is preferable to further comprise a controller for stopping the supply of the liquid mixture from the collection system to the liquid regulator when the detector detects the power change.

An image forming apparatus according to another aspect of the present invention comprises a photoconductive drum for bearing a toner image on the outer circumferential surface thereof; a developing device to be replenished with a liquid developer containing toner particles and a carrier and adapted to supply the liquid developer to the photoconductive drum; a developer former for forming the liquid developer having a mixing ratio of the toner particles and the carrier regulated; a first supply system for supplying the liquid developer having a toner density higher than the liquid developer used in the developing device to the developer former; a second supply system for supplying the carrier to the developer former; a third supply system for supplying the liquid developer formed in the developer former to the developing device via a reserve tank; and a collection system for collecting the liquid developer, which was supplied to the liquid consuming device, but not consumed by the developing device or the photoconductive drum, and supplying it to the developer former, wherein the developer former includes a container for containing the liquid developer and a liquid volume detector for detecting the volume of the liquid developer in the container, the liquid volume detector including a liquid level detecting member which is provided at a specified height position in the container and on which a load acts by the liquid developer when the liquid level in the container is located at the specified height position; and a first drive source connected to the liquid level detecting member for moving the liquid level detecting member.

According to this construction, the height position of the liquid level, i.e., the liquid volume can be accurately detected even if the viscosity of the liquid is high, wherefore the volume of the liquid developer in the developer generator can be more easily controlled. Therefore, the liquid developer can be properly mixed and circulated without leaking out of the container.

In the above construction, it is preferable that the first drive source is a motor; that the liquid level detecting member is driven and rotated by the motor; that a detector for calculating power given to the motor is further provided; and that the detector detects a power change based on the action of a load of the liquid developer on the liquid level detecting member.

In this case, it is preferable to further comprise a controller for stopping the supply of the liquid developer from the collection system to the developer former when the detector detects the power change.

In the above construction, it is preferable that an agitating member arranged in the container for agitating the liquid and a second drive source connected to the agitating member for supplying a driving force for agitating the liquid developer to the agitating member are further provided; and that the agitating member includes a first rotary shaft connected with the second drive source and a first fin member connected with the first rotary shaft.

Further, the liquid level detecting member preferably includes a tubular second rotary shaft to be rotated by the first drive source, rotatable relative to the first rotary shaft and arranged around the first rotary shaft, an annular member connected with the second rotary shaft and a second fin member provided around the annular member.

In this case, it is preferable that the annular member includes a first annular member having a specified outer diameter and a second annular member arranged concentrically with the first annular member and having an inner diameter larger than the outer diameter of the first annular member; and that the second fin member is provided between the first and second annular member.

This application is based on patent application No. 2006-309540 filed in Japan, the contents of which are hereby incorporated by references.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to embraced by the claims.

What is claimed is:

1. A liquid volume detector for detecting the volume of a liquid in a container, comprising:

a liquid level detecting member which is provided at a specified height position in the container and on which a load acts by the liquid when the liquid level in the container is located at the specified height position; and a first drive source connected to the liquid level detecting member for moving the liquid level detecting member.

2. A liquid volume detector according to claim 1, wherein the first drive source rotates the liquid level detecting member.

3. A liquid volume detector according to claim 1, further comprising:

an agitating member arranged in the container for agitating the liquid; and a second drive source connected to the agitating member for supplying a driving force for agitating the liquid to the agitating member.

4. A liquid volume detector according to claim 3, wherein the agitating member includes a first rotary shaft connected with the second drive source and a first fin member connected with the first rotary shaft.

5. A liquid volume detector according to claim 2, wherein the liquid level detecting member includes:

a second rotary shaft to be rotated by the first drive source, an annular member connected with the second rotary shaft and a second fin member provided around the annular member.

6. A liquid volume detector according to claim 5, wherein:

the annular member includes a first annular member having a specified outer diameter and a second annular member arranged concentrically with the first annular member and having an inner diameter larger than the outer diameter of the first annular member; and the second fin member is provided between the first and second annular members.

7. A liquid volume detector according to claim 4, wherein the liquid level detecting member includes:

a tubular second rotary shaft to be driven by the first drive source, rotatable relative to the first rotary shaft and arranged around the first rotary shaft, an annular member connected with the second rotary shaft and a second fin member arranged around the annular member.

8. A liquid volume detector according to claim 7, wherein the leading end of the second rotary shaft is located at such a position of the first rotary shaft as not be substantially immersed into the liquid level; and the liquid volume detector further comprises a connecting member connecting the leading end of the second rotary shaft and the annular member.

9. A liquid volume detector according to claim 7, wherein the annular member has an inner diameter larger than the outer diameter of the first fin member and is located at a height position higher than the first fin member.

10. A liquid mixture supply system, comprising:

a liquid consuming device for consuming a liquid mixture containing a first component and a second component;

a liquid regulator for forming the liquid mixture having a mixing ratio of the first and second components regulated;

a first supply system for supplying the first component to the liquid regulator;

a second supply system for supplying the second component to the liquid regulator;

a third supply system for supplying the liquid mixture formed in the liquid regulator to the liquid consuming device; and a collection system for collecting the liquid mixture, which was supplied to the liquid consuming device, but not consumed by the liquid consuming device, and supplying it to the liquid regulator, wherein:

the liquid regulator includes a container for containing the liquid mixture and a liquid volume detector for detecting the volume of the liquid mixture in the container, the liquid volume detector including:

a liquid level detecting member which is provided at a specified height position in the container and on which a load acts by the liquid mixture when the liquid level in the container is located at the specified height position, and a first drive source connected to the liquid level detecting member for moving the liquid level detecting member.

11. A liquid mixture supply system according to claim 10, wherein:

the first drive source is a motor, the liquid level detecting member is driven and rotated by the motor;

the liquid mixture supply system further comprises a detector for calculating power given to the motor; and the detector detects a power change based on the action of a load of the liquid mixture on the liquid level detecting member.

12. A liquid mixture supply system according to claim 11, further comprising a controller for stopping the supply of the liquid mixture from the collection system to the liquid regulator when the detector detects the power change.

13. An image forming apparatus, comprising:

a photoconductive drum for bearing a toner image on the outer circumferential surface thereof;

a developing device to be replenished with a liquid developer containing toner particles and a carrier and adapted to supply the liquid developer to the photoconductive drum;

a developer former for forming the liquid developer having a mixing ratio of the toner particles and the carrier regulated;

a first supply system for supplying a liquid developer having a toner density higher than the liquid developer used in the developing device to the developer former;

a second supply system for supplying the carrier to the developer former;

a third supply system for supplying the liquid developer formed in the developer former to the developing device via a reserve tank; and a collection system for collecting the liquid developer, which was supplied to the developing device, but not consumed by the developing device or the photoconductive drum, and supplying it to the developer former, wherein the developer former includes a container for containing the liquid developer and a liquid volume detector for detecting the volume of the liquid developer in the container, the liquid volume detector including:

a liquid level detecting member which is provided at a specified height position in the container and on which a load acts by the liquid developer when the liquid level in the container is located at the specified height position, and a first drive source connected to the liquid level detecting member for moving the liquid level detecting member.

14. An image forming apparatus according to claim 13, wherein:

the first drive source is a motor;

the liquid level detecting member is driven and rotated by the motor;

the image forming apparatus further comprises a detector for calculating power given to the motor; and the detector detects a power change based on the action of a load of the liquid developer on the liquid level detecting member.

15. An image forming apparatus according to claim 14, further comprising a controller for stopping the supply of the liquid developer from the collection system to the developer former when the detector detects the power change.

16. An image forming apparatus according to claim 13, further comprising:

an agitating member arranged in the container for agitating the liquid, and a second drive source connected to the agitating member for supplying a driving force for agitating the liquid developer to the agitating member, wherein the agitating member includes a first rotary shaft connected with the second drive source and a first fin member connected with the first rotary shaft.

17. An image forming apparatus according to claim 16, wherein the liquid level detecting member includes:

a tubular second rotary shaft to be rotated by the first drive source, rotatable relative to the first rotary shaft and arranged around the first rotary shaft, an annular member connected with the second rotary shaft, and a second fin member provided around the annular member.

18. An image forming apparatus according to claim 17, wherein:

the annular member includes a first annular member having a specified outer diameter and a second annular member arranged concentrically with the first annular member and having an inner diameter larger than the outer diameter of the first annular member; and the second fin member is provided between the first and second annular member.

* * * * *